United States Patent [19]

Pebdani

[11] Patent Number: 4,961,467

[45] Date of Patent: Oct. 9, 1990

[54] ENHANCED OIL RECOVERY FOR OIL RESERVOIR UNDERLAIN BY WATER

[75] Inventor: Farrokh N. Pebdani, Coppell, Tex.

[73] Assignee: Mobil Oil Corporation, Fairfax, Va.

[21] Appl. No.: 437,063

[22] Filed: Nov. 16, 1989

[51] Int. Cl.[5] ..... E21B 43/24; E21B 43/243

[52] U.S. Cl. ..... 166/261; 166/263; 166/272

[58] Field of Search ..... 166/261, 263, 272

[56] References Cited

U.S. PATENT DOCUMENTS

| | | | |
|---|---|---|---|
| 3,170,515 | 2/1965 | Willman | 166/261 |
| 3,727,686 | 4/1973 | Prats et al. | 166/261 |
| 3,872,924 | 3/1975 | Clampitt | 166/261 |
| 3,978,920 | 9/1976 | Bandyopadhyay et al. | 166/261 X |
| 3,997,004 | 12/1976 | Wu | 166/272 X |
| 4,068,715 | 1/1978 | Wu | 166/272 X |
| 4,450,910 | 5/1984 | Hunt, III. | 166/261 |
| 4,484,630 | 11/1984 | Chung | 166/263 |
| 4,566,537 | 1/1986 | Gussis | 166/261 |
| 4,635,720 | 1/1987 | Chew | 166/272 X |
| 4,638,864 | 1/1987 | Bousaid | 166/261 X |

*Primary Examiner*—George A. Suchfield

*Attorney, Agent, or Firm*—Alexander J. McKillop; Charles J. Speciale; Lawrence O. Miller

[57] ABSTRACT

A method for recovering viscous oil from a subterranean, viscous oil-containing formation underlain by a water zone. Steam is injected into the formation via the injection well at the oil/water contact and oil is recovered from the formation until steam breakthrough occurs at the production well thereby forming a hot plate at the oil/water contact. Thereafter, the production well is shut-in and a combustion-supporting gas, preferably pure oxygen, is injected into the formation at the oil/water contact causing an in-situ combustion reaction to occur at the oil/water contact and pressurization of the formation. Injection of the combustion-supporting gas is continued until the formation is pressurized to a specific pressure not to exceed the pressure at which fracture of the overburden above the formation would occur. Thereafter, the injection well is shut-in and oil is recovered from the formation via the production well. If desired, after injection of the combustion-supporting gas is discontinued, the formation may be subjected to a soak period by shutting-in the injection and production wells for a time sufficient to allow the injected combustion-supporting gas to be consumed in the in-situ combustion reaction.

6 Claims, 1 Drawing Sheet

ENHANCED OIL RECOVERY FOR OIL RESERVOIR UNDERLAIN BY WATER

BACKGROUND OF THE INVENTION

1. Field of the Invention

This invention concerns a thermal oil recovery method utilizing steam and in-situ combustion in a method which permits efficient recovery from formations with continuously underlying water zones.

2. Description of the Prior Art

In the recovery of petroleum crude oils from subterranean reservoirs, it usually is possible to recover only a minor portion of the oil originally in place in a reservoir by the so-called primary recovery methods, i.e., those methods which utilize only the natural forces present in the reservoir. Thus, a variety of supplemental recovery techniques have been employed in order to increase the recovery of oil from subterranean reservoirs. In these supplemental techniques which are commonly referred to as secondary recovery operations, although they may be primary or tertiary in sequence of employment, energy is supplied to the reservoir as a means of moving the oil in the reservoir to suitable production wells through which it may be withdrawn to the surface of the earth. Perhaps the most common secondary recovery processes are those in which displacing fluids such as water or gas are injected into an oil-bearing reservoir in order to displace the oil therein to suitable production wells.

Steam has been used in many different methods for the recovery of oil from subterranean, viscous oil-containing formations. The two most basic processes using steam for the recovery of oil includes a "steam drive" process and a "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through an injection well, stopping the injection of steam, permitting the formation to soak and then back producing oil through the original injection well.

Another secondary recovery process which has shown promise is the concurrent or forward burn in-situ combustion technique. In this procedure, a portion of the reservoir oil is burned or oxidized in-situ to create a combustion front. This combustion front is advanced through the reservoir in the direction of one or more production wells by the injection of a combustion-supporting gas through one or more injection wells. The combustion front is preceded by a high temperature zone, commonly called a "retort zone," within which the reservoir oil is heated to effect a viscosity reduction and is subjected to distillation and cracking. Hydrocarbon fluids including the heated, relatively low viscosity oil and the distillation and cracking products of the oil then are displaced toward production wells where they are subsequently withdrawn to the surface of the earth. The in-situ combustion procedure is particularly useful in the recovery of thick, heavy oils such as viscous petroleum crude oils and the heavy, tar-like hydrocarbons present in tar sands. While these tar-like hydrocarbons may exist as solid or semi-solid materials in their native state, they undergo a sharp viscosity reduction upon heating and in the portion of the reservoir where the temperature has been increased by the in-situ combustion process behave like the more conventional petroleum crude oils.

Thermal recovery from heavy oil reservoirs underlain by water has been plagued by the poor performance of the Cyclic steam process. Even though the wells are completed in the oil leg only, steam finds a path to the water leg either from behind the casing or by sweeping a small area around the wellbore in the first cycle and only penetrates the water leg in the subsequent cycles. The present invention provides a new and novel recovery technique utilizing steam injection and in-situ combustion for recovering heavy oil from heavy oil-containing reservoir overlying a water saturated zone.

SUMMARY OF THE INVENTION

The method of the present invention involves a method for recovering oil from a subterranean, viscous oil containing formation underlain by a water stratum at an oil/water contact penetrated by at least one injection well and at least one spaced apart production well which penetrate the water saturated zone. The injection well is in fluid communication with 15–25% of the thickness of the oil formation in the bottom of the oil-saturated zone and essentially an equal amount in the top of the water saturated zone. The production well is completed substantially throughout the entire oil-saturated zone and a small amount, i.e., about 5% of the thickness of the oil formation in the top of the water-saturated zone. Initially, steam is injected at about the level of the oil/water contact and oil is recovered from the formation via the production well until steam breakthrough occurs at the production well. Thereafter the production well is shut in and a combustion supporting gas, preferably pure oxygen, is injected at about the level of the oil/water contact to establish an in-situ combustion reaction. Injection of the combustion supporting gas is continued until the formation is pressurized to a predetermined level. Thereafter the injection well is shut in and oil is recovered from the formation via the production well. If desired, the formation may be subjected to a soak period by shutting in both the injection and production wells after injection of the combustion supporting gas has been discontinued for a time sufficient for the combustion supporting gas to be consumed in the in-situ combustion reactions. The steps comprising injecting steam, in-situ combustion and pressurization, soak, if one is used, followed by production, may be repeated for a plurality of cycles.

DESCRIPTION OF THE PREFERRED EMBODIMENTS

Basically, the process of my invention involves a three-stage thermal oil recovery method from formations with continuously underlying water zones. First steam is injected at or near the oil/water contact by means of a well in the bottom of the oil zone and the top of the water zone until steam breakthrough occurs at the production well. The steam is injected at a high injection rate to establish rapid breakthrough with the production well. Some oil will be displaced by the steam since the injected steam will sweep a portion of the overlying oil saturated interval, but will be substantially confined to a relatively thin zone at the oil/water interface of the formation. The injected steam creates a hot plate underneath the oil zone 1. In the second phase, the production well is shut-in and a combustion-supporting gas, preferably pure oxygen, is injected at or near the oil/water contact so as to initiate and propagate an in-situ combustion reaction radially at the oil/water interface. Ignition will occur instantaneously due to the existence of the hot plate created by the previously injected steam. The combustion reaction generates appreciable heat which raises the temperature of the oil contained in the oil saturated zone above which is not involved in the combustion reaction thereby reducing the oil viscosity and improving its mobility. Other benefits such as thermal cracking and upgrading of the oil, viscosity reduction and swelling of the oil due to carbon dioxide dissolution also helps in further improving the ultimate oil recovery. Injection of the combustion-supporting gas is continued and the reservoir is pressured up to a specified pressure not to exceed the pressure at which fracture of the overburden above the formation would occur which depends on the reservoir and fluid properties.

After the desired formation pressure is obtained, injection of combustion-supporting gas is then stopped and if desired, the injection and production wells are shut-in to allow the injected oxidant to be consumed for a variable time, preferably from 2 to 10 days per vertical thickness in feet of the viscous oil-containing formation. Thereafter, in the third phase, the injection well is shut-in, the production well is opened and the formation is depressurized and oil is produced via the production well. The oil recovery process is continued with subsequent cycles comprising steam injection, in-situ combustion with pressurization, and if desired, shutting-in the injection and production wells to allow the combustion-supporting gas to be consumed followed by production and depressurization until the oil recovery efficiency begins to drop off as is detected by a reduction in the ratio of produced oil to the injected steam and oxygen.

Figure 1:
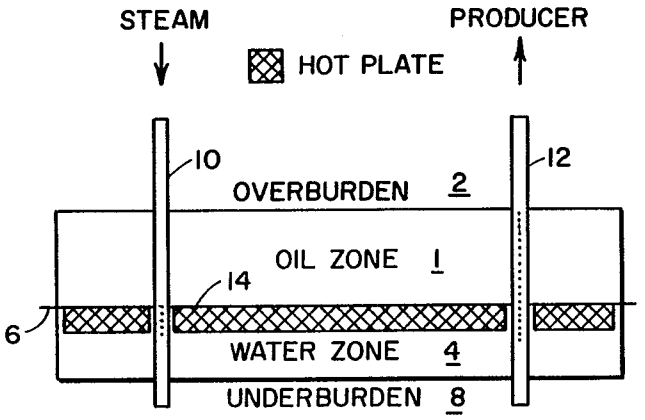
FIG. 1 illustrates in cross-sectional view of a subterranean, viscous oil-containing formation overlying a water saturated zone to which the process of my invention is being applied, showing the method of completing the wells and the results of the first phase of the process of my invention, injection of steam at the oil/water contact.

The process may be more readily understood by referring to the attached FIG. 1 in which an oil saturated zone 1 under overburden 2 is underlain by a water saturated zone 4 at oil/water contact 6. Water saturated zone 4 is underlain by an underburden 8. The water saturated zone 4 is essentially continuous along the bottom of the portion of the oil-saturated zone 1 to be exploited by means of the subject process. Injection well 10 and production well 12 extend through the oil saturated zone and penetrate the water saturated zone 4 by a distance equal to at least 10% of the thickness of the oil-saturated zone 1. Injection well 10 is in fluid communication with about 15–25% of the thickness of the oil-saturated zone 1 and essentially an equal amount in the top of the water zone 4 by means of perforations. Production well 12 is perforated from about 80 to 100% the thickness of the oil-saturated zone 1 plus a small amount, i.e. about 5% of the thickness of the oil formation in the top of the water-saturated zone, preferably about 5 feet into the water zone 4.

In the first stage of operation, steam is injected into the lower portion of the formation at the oil/water contact 6 and oil is recovered from the lower portion of the formation between the oil zone and the water zone via the production well 12. The injected steam is confined to the oil/water contact 6 between the oil zone 1 and the water zone 4. The reason for the confinement of steam to the oil/water contact 6 is because the oil saturated zone 1 has a very low permeability due to the high viscosity of the oil contained therein, and therefore very little steam penetration will result into this zone. Either superheated or saturated steam may be used, but generally economics dictates that saturated steam be utilized. It is generally satisfactory to use steam in the quality range from about 50 to 70 percent.

The injected steam migrates along the oil/water contact 6 as it moves through the formation between injection well 10 and production well 12 creating a hot plate 14. Steam injection and production of oil is continued until there is steam breakthrough at production well 12. The steam is injected at a high injection rate to establish rapid breakthrough at the production well 12.

Figure 2:
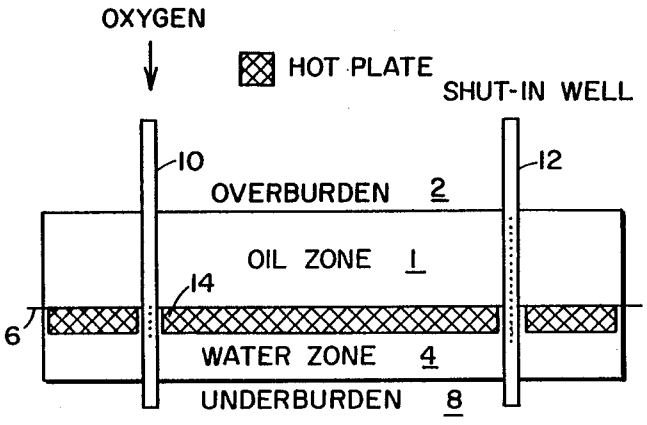
FIG. 2 illustrates in cross-sectional view essentially the same subject as is shown in FIG. 1, and the results of the second phase of the process of my invention, the in-situ combustion at the oil/water contact.

In the second step of my process, an in-situ combustion process is initiated by injecting a combustion-supporting gas such as air, oxygen-enriched air or pure oxygen, preferably pure oxygen, at the oil/water contact 6 via injection well 10 and production well 12 is shut-in in order to increase the pressure in the formation as illustrated in FIG. 2. Ignition of reservoir hydrocarbons and the oxygen or air and oxygen mixture will occur instantaneously due to the existence of the hot plate 14 formed by previously injected steam. Once combustion is attained, the combustion front is propagated through the formation toward the production well 12. As the in-situ combustion process operation proceeds, pressurization of the formation occurs and the heat generated by the combustion process, where temperatures range from 1500° F. to 2000° F., is conducted upward into the oil zone 1 which lowers the viscosity of the in-place oil and improves its mobility. An added advantage during this phase is thermal cracking and upgrading of the in-place oil because of excessive temperatures (1500–2000° F.) during combustion, further viscosity reduction and swelling of the oil due to carbon dioxide (by product of combustion reaction) dissolution in oil which also results in further improving ultimate recovery of the oil. Injection of the combustion-supporting gas is continued until the formation pressure is increased to a specific pressure not to exceed the pressure at which fracture of the overburden above the formation would occur which will depend upon formation and fluid properties.

Figure 3:
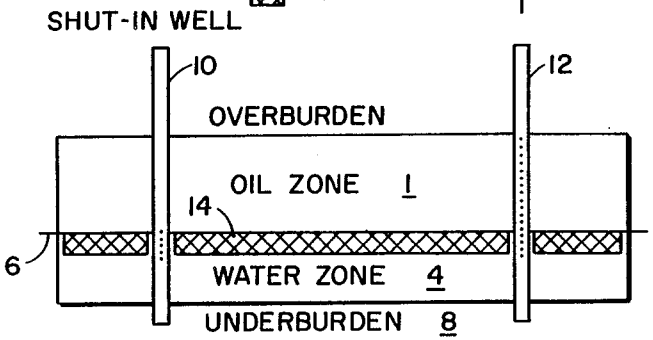
FIG. 3 illustrates the third phase of my process in which oil is produced from the formation via the production well and the formation is depressurized by shutting in the injection well.

In the third step of my process, injection well 10 is shut-in and oil is recovered from the lower portion of the formation between the oil zone and the water zone via the production well 12 as illustrated in FIG. 3. As production is continued the formation is depressurized. In another embodiment, if desired, after in-situ combustion has been discontinued and before production of oil via the production well, both the injection and production wells are shut-in to permit the formation to undergo a soak period for a time sufficient to allow the injected combustion-supporting gas to be consumed in the in-situ combustion reaction, thereby maximizing reduction of the viscosity of the oil in the formation and increasing its mobility. This will also ensure that all of the injected oxygen is consumed and none will be encountered at the production well, which is often a safety concern. Once the soak period has been completed, oil is recovered from the formation via the production well.

The oil recovery process is continued with alternating cycles comprising steam injection, in-situ combustion with pressurization, a soak period if desired, and production with depressurization.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al., the disclosure of which is hereby incorporated by reference.

From the foregoing specification one skilled in the art can readily ascertain the essential features of this invention and without departing from the spirit and scope there of can adopt it to various diverse applications. It is my intention that my invention be limited and restricted only by those limitations and restrictions as appear in the appended claims.

I claim:

1. A method for recovering oil from a subterranean, viscous oil-containing formation underlain by a water stratum at an oil/water contact, said petroleum formation being penetrated by at least one injection well and at least one spaced apart production well which penetrate the water stratum by a distance equal to at least 10% of the thickness of the oil-containing zone comprising:

(a) establishing fluid communication between the injection well and the bottom 15 to 25% of the oil-containing zone and a similar distance into the water stratum;

(b) establishing fluid communication between the production well and substantially the full thickness of the oil-containing zone plus a distance into the top of the water stratum equal to about 5% of the thickness of the oil-containing zone;

(c) injecting steam via the injection well into the formation at about the level of said oil/water contact and recovering oil from the formation via said production well until steam breakthrough occurs at the production well;

(d) shutting-in the production well and injecting a combustion-supporting gas into said injection well to establish an in-situ combustion reaction in said formation at about the level of said oil/water contact;

(e) continuing injecting combustion-supporting gas into the formation until the formation is pressurized to a predetermined level; and (f) shutting-in the injection well and recovering oil from the formation via the production well.

2. The method of claim 1 wherein steps (a) through (d) are repeated for a plurality of cycles.

3. The method of claim 1 wherein the combustion-supporting gas is pure oxygen.

4. The method of claim 1 comprising the additional step after step (c) of shutting in the injection well and production well to permit said formation to undergo a soak period for a time sufficient for the combustion-supporting gas to be consumed in the in-situ combustion reaction.

5. The method of claim 4 wherein the soak period is for a period of time between 2 and 10 days per vertical thickness in feet of the oil-containing formation.

6. The method of claim 1 wherein injection of the combustion-supporting gas during step (c) is continued until the formation is pressurized to a maximum pressure that does not exceed the pressure at which fracture of the overburden above the formation would occur.

* * * * *